US007328586B2

(12) United States Patent
Gau et al.

(10) Patent No.: US 7,328,586 B2
(45) Date of Patent: Feb. 12, 2008

(54) REPOSITIONABLE ATTENUATOR

(75) Inventors: David Gau, Allen, TX (US); Terry Kelley, Sachse, TX (US)

(73) Assignee: Air Systems Components, L.P., Richardson, TX (US)

( * ) Notice: Subject to any disclaimer, the term of this patent is extended or adjusted under 35 U.S.C. 154(b) by 146 days.

(21) Appl. No.: 11/118,637

(22) Filed: Apr. 29, 2005

(65) Prior Publication Data

US 2005/0252712 A1 Nov. 17, 2005

Related U.S. Application Data

(60) Provisional application No. 60/567,119, filed on Apr. 30, 2004.

(51) Int. Cl.
*G05D 23/32* (2006.01)
*F25D 19/00* (2006.01)

(52) U.S. Cl. ..... 62/158; 62/296; 181/241; 165/135; 454/906

(58) Field of Classification Search ..... 62/296, 62/314, 414, 419, 158; 181/241, 219, 225, 181/243; 165/135; 454/906
See application file for complete search history.

(56) References Cited

U.S. PATENT DOCUMENTS 2,382,159 A * 8/1945 Klemm ..... 181/241
2,716,463 A * 8/1955 Latulippe ..... 181/267
3,042,138 A * 7/1962 Reinert ..... 181/241
3,141,519 A * 7/1964 Bottum ..... 181/241
3,181,648 A * 5/1965 Bottum ..... 181/277
3,662,542 A * 5/1972 Streb ..... 60/320
4,715,472 A * 12/1987 McKee ..... 181/241
5,313,803 A * 5/1994 Detzer ..... 62/89
5,663,535 A 9/1997 MacDonald et al.
6,019,677 A 2/2000 Demster
6,079,626 A 6/2000 Hartman
6,520,285 B2 * 2/2003 Tobias ..... 181/241
6,892,851 B2 * 5/2005 Lee ..... 181/224
2002/0036114 A1 * 3/2002 Tobias ..... 181/241
2004/0108162 A1 * 6/2004 Couvrette ..... 181/241
2005/0011697 A1 * 1/2005 Arlasky ..... 181/225

FOREIGN PATENT DOCUMENTS

JP 2001-12228 A * 1/2001

* cited by examiner

*Primary Examiner*—Mohammad M. Ali
(74) *Attorney, Agent, or Firm*—Calfee, Halter & Griswold LLP

(57) ABSTRACT

A repositionable attenuator for a terminal unit in a heating, ventilation, and air conditioning system is disclosed. The attenuator is positionable between at least a first and a second position. This enables the attenuator to be attached to and shipped with the terminal unit prior to installation of the terminal unit.

15 Claims, 5 Drawing Sheets

REPOSITIONABLE ATTENUATOR

CROSS REFERENCE TO RELATED APPLICATION

This application claims the benefit under 35 U.S.C. § 119(e) of U.S. Provisional Application 60/567,119 filed Apr. 30, 2004, titled REPOSITIONABLE ATTENUATOR, which application is hereby incorporated by reference in its entirety.

BACKGROUND

The present invention is directed to an attenuator that can be used in a variable air volume terminal unit, a terminal unit incorporating the attenuator, and clips for fastening the attenuator.

Discharge and radiated sound is of concern with variable air volume (VAV) terminal units, such as may be used in heating, ventilation, and air conditioning (HVAC) systems. In a VAV system, one or more central air supply systems are sized to meet the peak cooling (and/or heating) conditions for the building. Several terminal units are located in respective zones or offices throughout the building, each connected via ducts to the central air supply. In such a terminal unit, the volume of air urged through a diffuser over a given length of time is controlled. Some terminal units have a fan or pump driven by a motor to move the air from the central air supply through the diffuser associated with the terminal unit. VAV terminal units permit "personalizing" the temperature of a particular room or group of rooms as desired by the occupants.

While there may be several sources of objectionable sound in a HVAC system, at least every component of rotating machinery, e.g., the blower of an air handling unit, generates sound waves which propagate along the duct through the air flowing in the duct. And certain types of VAV terminal units include integral motor-driven fans. Unless attenuated to acceptable levels, the propagated sound waves may be evident to persons in the rooms served by the HVAC system. Conventional attenuators for this sound are external to the terminal unit and are either supplied and installed by the factory or are installed to the terminal unit in the field.

SUMMARY

An attenuator described in the present disclosure has at least one open side and is internal to the terminal unit and is positionable between at least two positions relative to the casing of the unit. Also described is a terminal unit having an attenuator that is positionable between at least a first position and second position. A kit is also described for fitting a terminal unit with a repositionable attenuator. Also described are clips suitable for use with the repositionable attenuator to allow for repositioning of the attenuator.

BRIEF DESCRIPTION OF THE DRAWINGS

In the accompanying drawings, which are incorporated in and constitute a part of this specification, embodiments of the invention are illustrated, which, together with a general description of the invention given above, and the detailed description given below, serve to exemplify the principles of this invention, wherein.

DETAILED DESCRIPTION

The present invention is described by exemplary embodiments herein, but is limited only by the claims appended hereto. The invention is capable of many embodiments, depending on the specific circumstances of each desired implementation. Departures from the embodiments described herein may be made by those of ordinary skill in the art without undue experimentation to accommodate a variety of specific implementations without departing from the spirit and scope of the invention.

Figure 1:
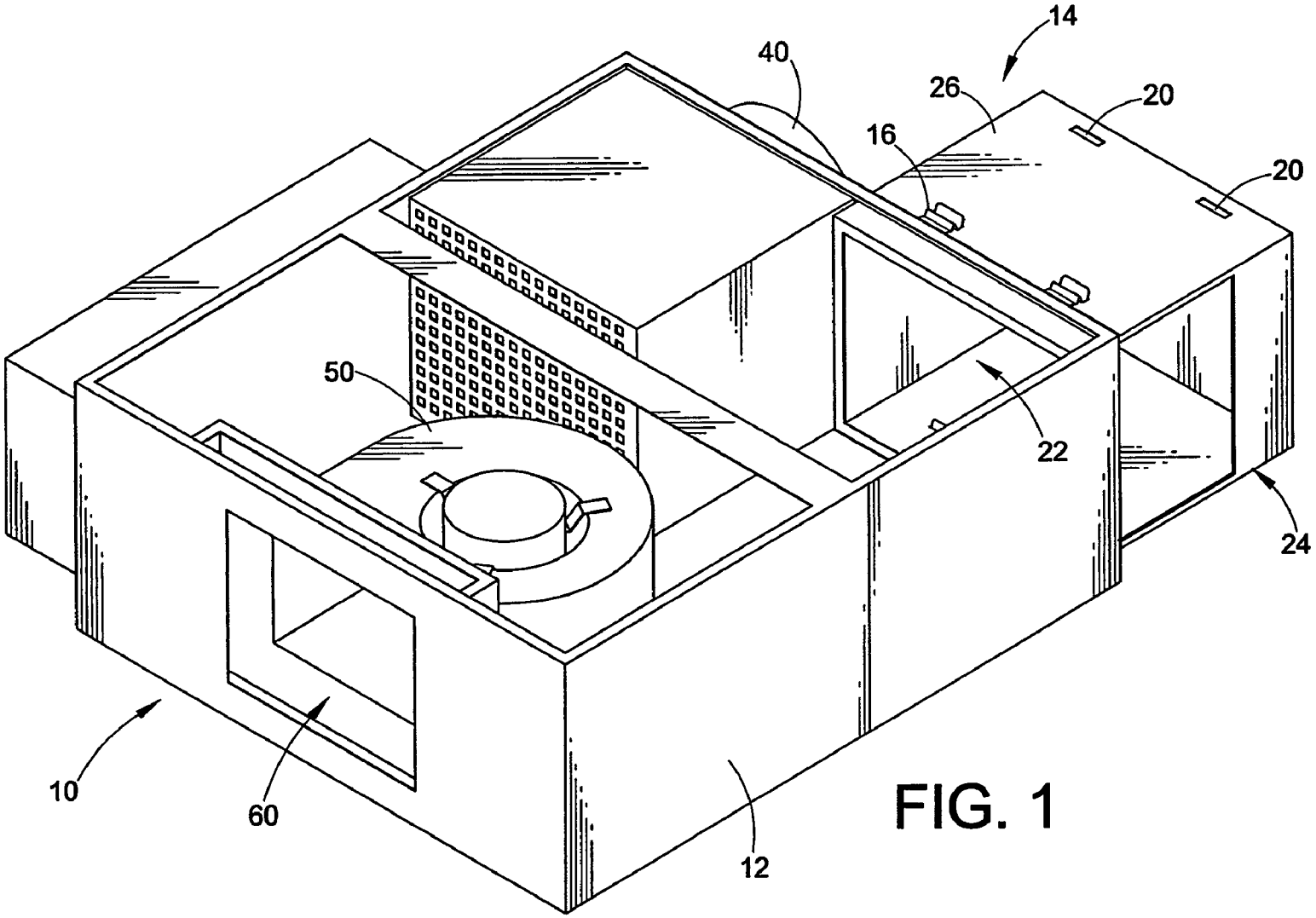
FIG. 1 is a perspective view illustrating a terminal unit in accordance with the present invention illustrating the attenuator in an "out" position.

FIG. 1 illustrates a VAV terminal unit 10 having a casing 12, an attenuator 14, and attenuator clips 16. FIGS. 1 through 4 illustrate the terminal unit 10 without a top portion of the casing 12 to enable illustration of the internal components of the terminal unit 10.

Figure 2:
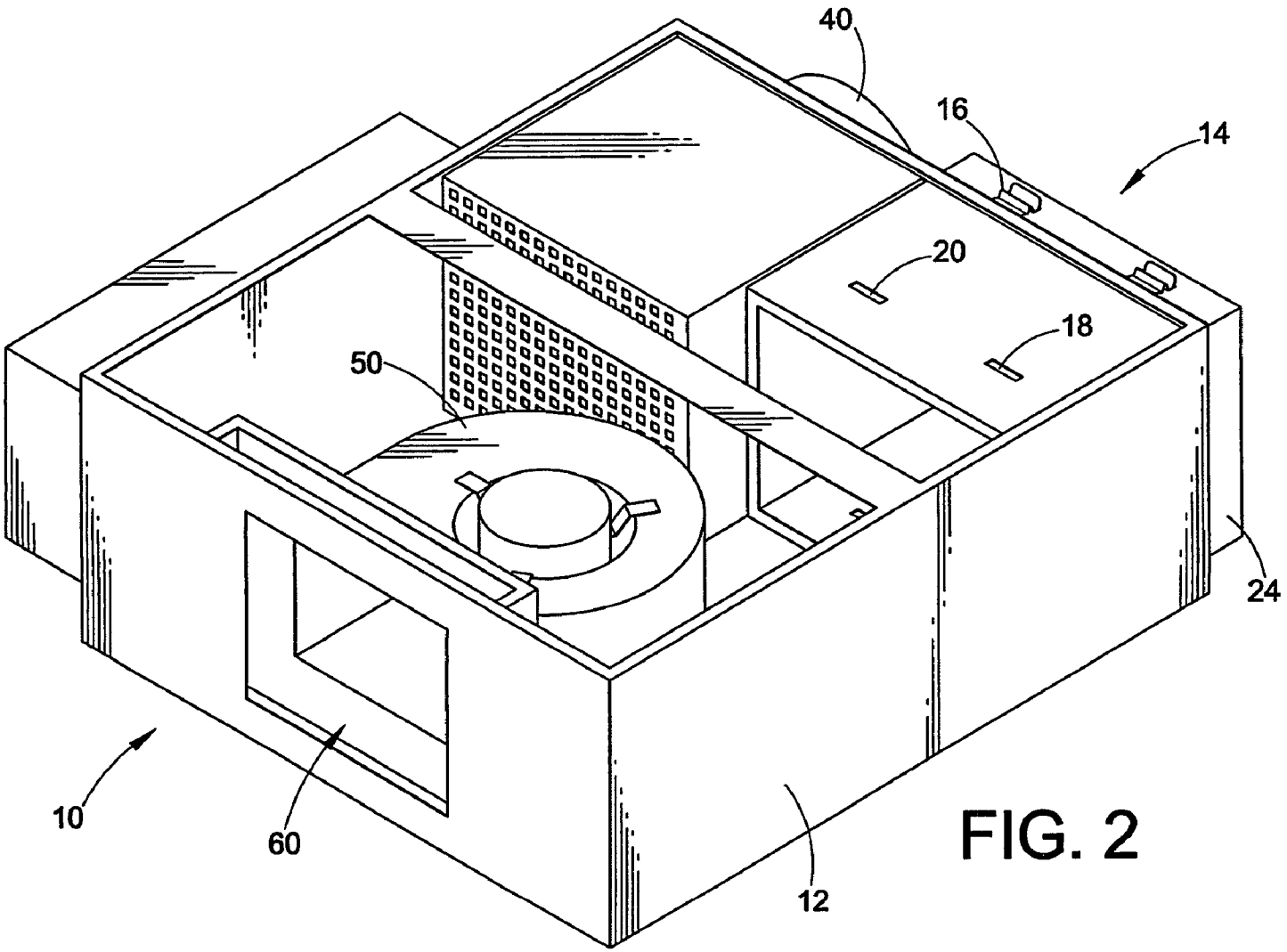
FIG. 2 is a perspective view illustrating the terminal unit of FIG. 1 with the attenuator in an "in" position.

The attenuator 14 is capable of being positioned, such as by sliding, relative to the casing 12 between a first, or "out," position illustrated in FIG. 1 and a second, or "in," position illustrated in FIG. 2. In the "out" position, more of the attenuator 14 is outside of the casing 12 of the terminal unit 10 than inside the casing 12. In the "in" position, more of the attenuator 14 is inside the casing 12 of the terminal unit 10 than outside of the casing 12. The attenuator 14 may also be completely removed from the casing 12, for example, to replace the attenuator 14.

Attenuator clips 16 cooperate with appropriate slots 18, 20 on the top of the attenuator 14 to retain the attenuator 14 in the "out" or "in" position. The attenuator 14 may also be secured in any position intermediate to the "in" or the "out" positions. Slots 18, 20 may be situated at any location on the attenuator 14 to facilitate securing the attenuator 14 in any position between fully removed from the casing 12 and completely inserted within the casing 12.

In one embodiment, the attenuator clips 16 are attached to the casing 12, such as via holes 30 illustrated in FIGS. 6 and 7A-7C. Fasteners 32 cooperate with the holes 30 and the casing 12 to retain the attenuator clips on the casing 12. The fasteners 32 may be any conventional fasteners, such as rivets, brads, screws, bolts, studs, pins, etc., without departing from the spirit and scope of the invention.

In one embodiment, the attenuator clips 16 are removably fastened to the casing 12, such as by removable fasteners 32. In another embodiment, the attenuator clips 16 are secured to the casing 12 without fasteners 32, such as with an adhesive, glue, resin, or the like. In another embodiment, fasteners 32 are integral with the casing 12, such as integral protrusions over which the holes 30 snap into place.

Attenuator clips 16 may also be provided to cooperate with slots 18, 20 located on the bottom or the sides of attenuator 14, as illustrated in FIG. 1.

Figure 4:
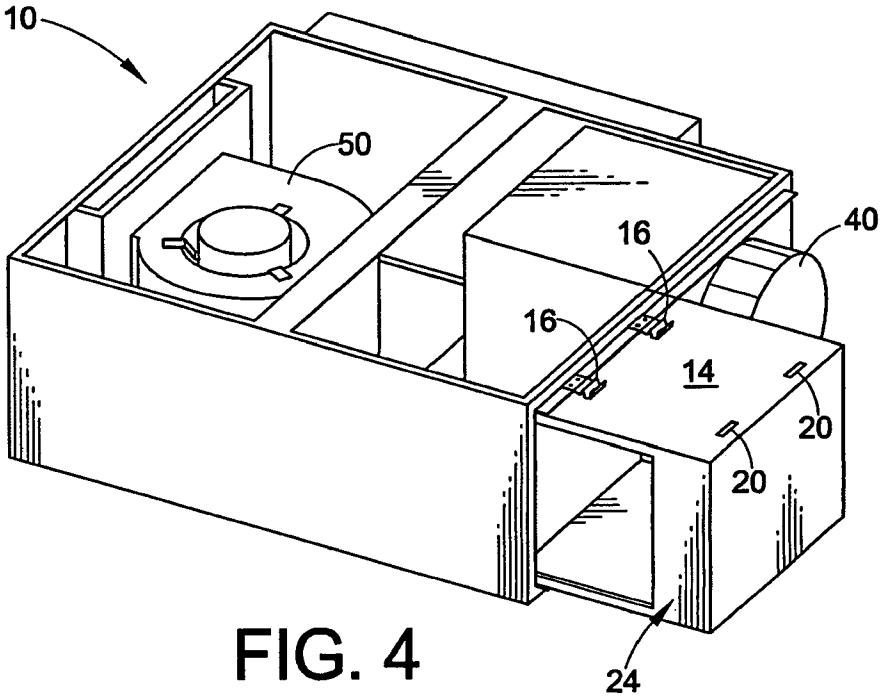
FIG. 4 is a perspective view of the terminal unit of claim 1.
Figure 3:
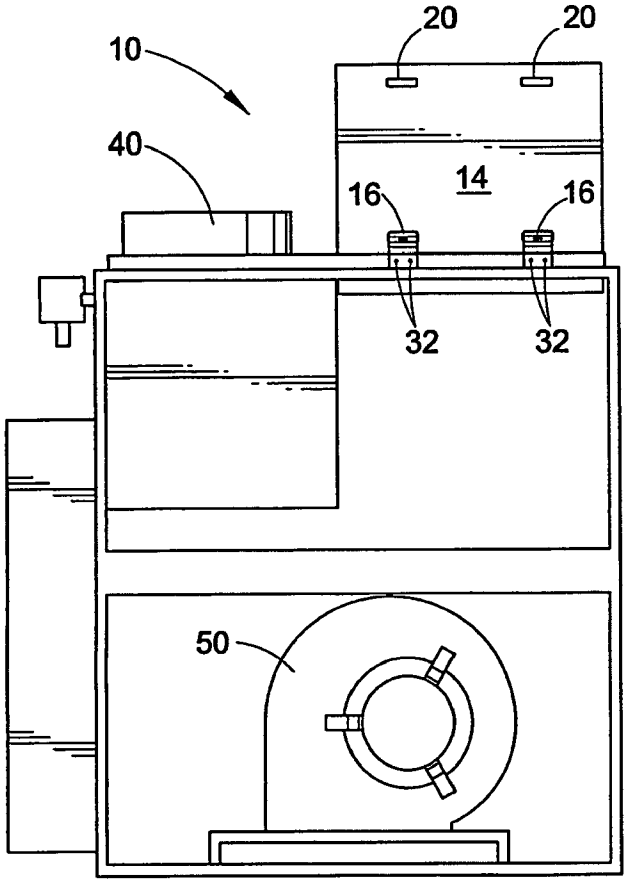
FIG. 3 is a top view of the terminal unit of FIG. 1.
Figure 6:
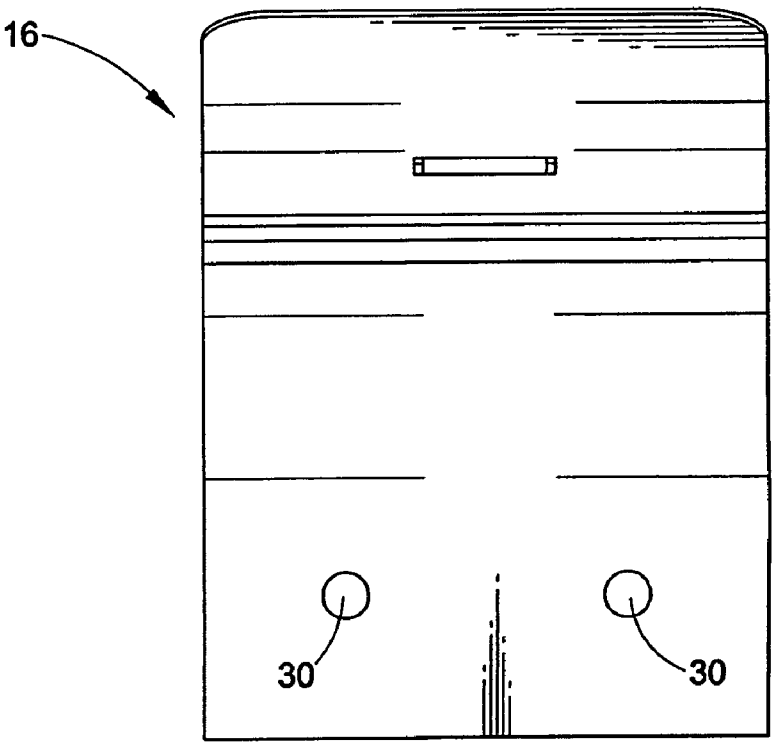
FIG. 6 is a top view of an attenuator clip in accordance with the present invention.

FIGS. 3 and 4 illustrate the attenuator 14 in the "out" position, with the attenuator clips 16 positioned to cooperate with slots 18.

Figure 5:
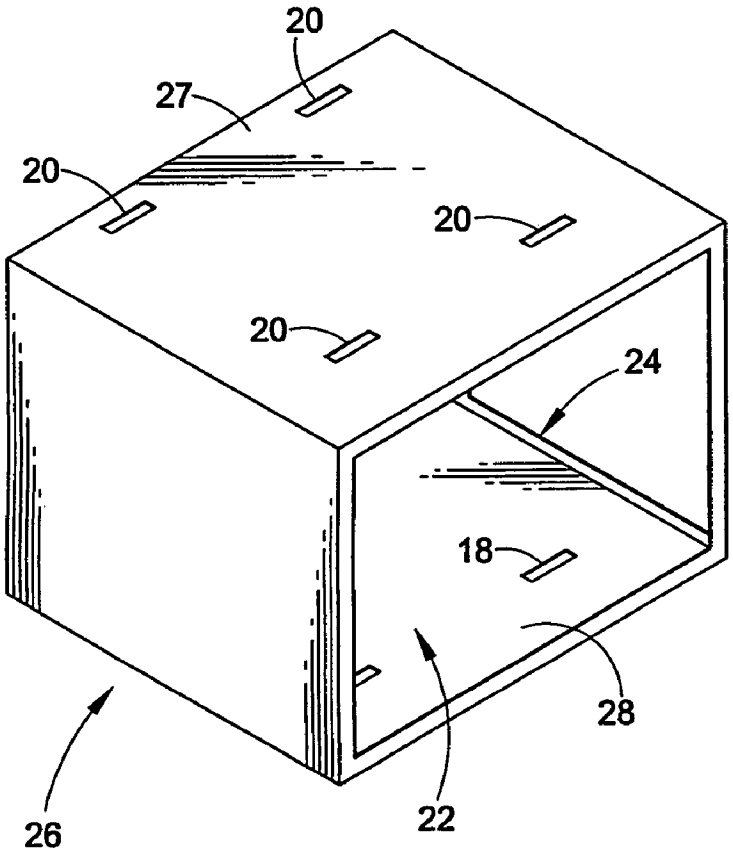
FIG. 5 is a perspective view of an attenuator in accordance with the present invention.

FIG. 5 illustrates the attenuator 14 having four slots 18, 20 in a top surface 27 thereof, with corresponding slots 18, 20 in a bottom surface 28. Any number of slots 18, 20 may be provided in the attenuator 14 without departing from the spirit and scope of the invention. The attenuator 14 may also be secured in the "in" position and the "out" position in any other manner presently known or later developed.

The attenuator 14 illustrated in FIGS. 1 and 5 has a body 26 with generally a rectangular prismatic shape with a first side 22 and a second side 24 open or at least not completely closed off. The shape of the body 26 of the attenuator 14 can also be described as a hollow box-like structure having the first side 22 and the second side 24 open, or at least not completely closed off. The first side 22 is disposed within the casing 12. The location of the second side 24 relative to the terminal unit 10 and the first side 22 is dependent on the geometry of the components of the particular terminal unit 10 and may be selected without departing from the spirit or scope of the invention.

The relative location of the attenuator 14 within the terminal unit 10 is generally dependent on the geometry and locations of the components within the terminal unit 10, and may be selected without departing from the spirit and scope of the invention.

When the attenuator 14 is in the "out" position, a flow path is enabled from outside the terminal unit 10, through the second side 24, into the attenuator 14, through the first side 22, and into the interior of the terminal unit 10. For example, if the terminal unit is placed in an HVAC system, the ambient air outside of the terminal unit 10 may be forced into the terminal unit 10 through the described flow path. The ambient air then mixes with chilled air provided to the interior of the terminal unit 10, such as through a primary air inlet 40 that is in communication with a chiller system. Then a fan 50 forces the mixed ambient and chilled air through an outlet 60 into a room, conduit, etc. in communication with the outlet 60.

Use of an attenuator 14 that is internal to and part of the terminal unit 10 may enable more accurate predictions for sound mitigation values because the attenuator 14 is a part of the terminal unit 10 and not an after-market addition that may or may not have been tested with the particular terminal unit 10. The attenuator 14 and the terminal unit 10 may occupy less space than a conventional unit because the attenuator 14 is internal to the terminal unit 10, possibly resulting in reduced costs for shipping, storage, etc. Also, there may be lower labor costs associated with installation of the attenuator and terminal unit of the present invention.

Conventional field-added attenuators can introduce undesirable performance characteristics into operation of a terminal unit, such as fan shift. This can result because the particular after-market, external attenuator may not have been tested with the specific terminal unit, and the operation of the existing terminal unit may have been optimized without the presence of an external attenuator. The terminal unit with repositionable attenuator of the present invention is unlikely to experience fan shift or other such undesirable performance characteristics, because any optimization of the terminal unit operation will be conducted with the attenuator as a part of the original manufacture of the terminal unit.

FIGS. 6 and 7A-7F illustrate an attenuator clip 16. As discussed above, in one embodiment, the attenuator clip 16 is provided with two holes 30 in a flat section 74. The holes 30 enable the attenuator clip 16 to be fastened to the casing 12. There may be any number of holes 30 in the attenuator clip 16. In other embodiments, the attenuator clip 16 does not have holes, and is fastened to the casing in other manners, as discussed above.

Figure 7C:
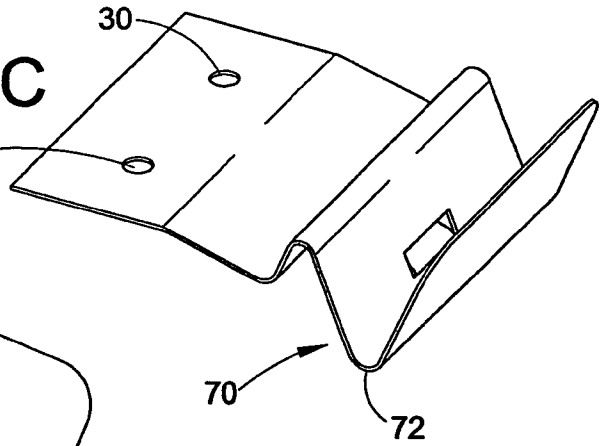
FIGS. 7A through 7F are schematic drawings of an attenuator clip in accordance with the present invention.
Figure 7B:
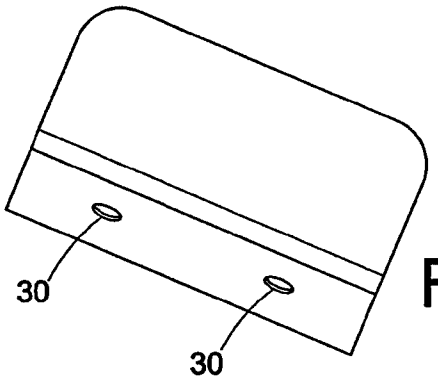
Figure 7F:
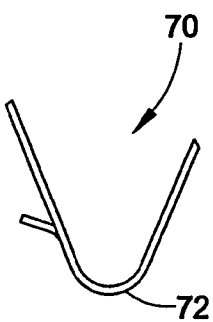
Figure 7E:
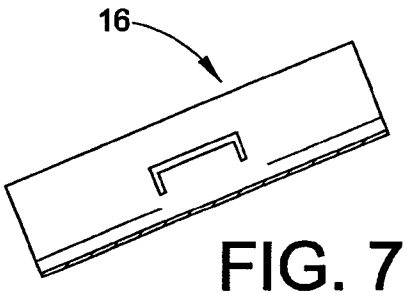
Figure 7A:
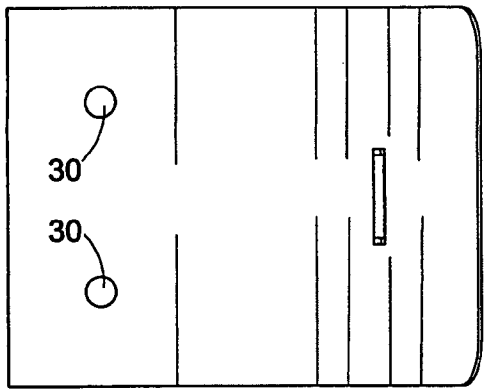
Figure 7D:
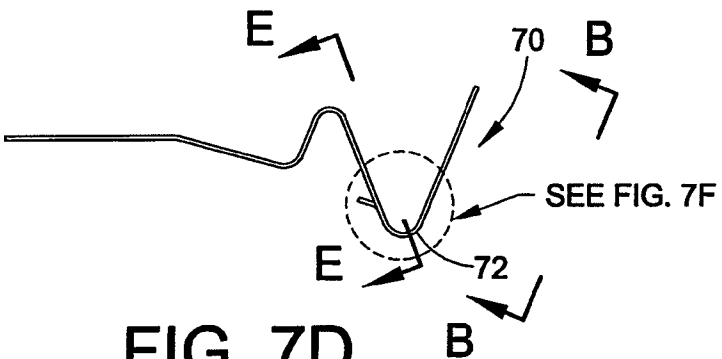

As best seen in FIGS. 7C and 7D, in one embodiment the attenuator clip 16 has a V-shaped section, indicated generally by numeral 70. The bottom 72 of the V-shaped section 70 cooperates with the slots 18, 20 to hold the attenuator 14 in place in the "in" or the "out" position. The V-shaped section 70 is connected to the flat section 74. In the embodiment illustrated in FIGS. 7A-7D, the V-shaped section 70 is connected to the flat section 74 via a curved section 76, although direct connection to the flat section 74 is within the spirit and scope of the invention. The curved section 76 is believed to assist with the resiliency of the clip 16 and in the capability of the clip 16 to be biased toward and disengaged from the slot 18, 20. The clip 16 also includes a tab 78 extending from a portion of the V-shaped section 70 closest to the flat section 74 toward the flat section 74, as illustrated in FIG. 7D.

The attachment of the clip 16 to the casing 12 is such that the V-shaped section 70 is disposed to be capable of cooperation with slot 18, 20. When the slot 18, 20 and the V-shaped section 70 are aligned to cooperate, at least a portion of the V-shaped section 70 enters the slot 18, 20 to a sufficient depth to secure the attenuator 14. The tab 78 prevents insertion of the V-shaped section 70 to an undesired depth in the slot 18, 20 and enables sufficient structure of the clip 16 to be available to disengage the clip 16 to reposition the attenuator 14.

The bottom 72 of the V-shaped section 70 is offset from the plane of the flat section 74, for example, "below" the plane of the flat section 74, as illustrated in FIG. 7D. This assists in providing a bias of the bottom 72 against the body of the attenuator 14 and the slot 18, 20. Thus, when the slot 18, 20 aligns with the bottom 72, the bottom 72 and V-shaped section 70 will "snap" into place in the slot 18, 20. Force must then be applied to the clip 16 to "lift" or disengage the bottom 72 and the V-shaped section 70 from the slot 18, 20. The clip 16 preferably has sufficient resiliency to enable the disengagement of the V-shaped section 70 from the slot 18, 20 without detachment of the clip 16 from the casing 12.

For clips 16 and slots 18, 20 associated with the bottom surface 28 of the attenuator, the operation and cooperation are the same, but the directions are different. For example, the bottom 72 is disposed "above" the plane of the flat section 74.

When it is desired to reposition the attenuator 14, the V-shaped section 70 is disengaged from the slot 18, 20, allowing movement of the attenuator 14 to a different position. When the same or different slot 18, 20 is then aligned with the same or different V-shaped section 70, the V-shaped section 70 engages the slot 18, 20 to secure the attenuator 14 at the different position.

If there is more than one clip 16 and slot 18, 20, then all clips 16 must be disengaged before the attenuator 14 is moved to the different position. As illustrated in the Figures, for example, there are a plurality of clips 16 and slots 18, 20 to provide for a plurality of positions of the attenuator 14.

The clips also provide some support to the attenuator 14, particularly when it is in its "out" position. The cooperation between the slot 18, 20 and the clip 14 also provide some protection against unintentionally completely disengaging the attenuator 14 from the casing 12.

In one embodiment, the attenuator clip 16 is made from high carbon spring steel. The attenuator clip 16 may be made from any material without departing from the spirit and scope of the invention.

The attenuator 14 and attenuator clips 16 of the present invention may also be used to retrofit existing terminal units, such as in a kit, depending on the geometry, component location, and other parameters of a particular existing terminal unit.

In one example of operation, the attenuator 14 is placed in the "in" position for shipping, storage, etc. When the terminal unit 10 is installed, or for testing, etc., the attenuator clips 16 engaging the slots 20 are disengaged and the attenuator 14 is repositioned to the "out" position. The attenuator clips 16 are then placed in engagement with the slots 18 to secure the attenuator 14 in the "out" position. If desired, the attenuator 14 may be completely removed from the casing 12 and the attenuator clips 16 not engaged with the slots 18, 20.

The attenuator 14 may be replaced in the "in" position by disengaging the attenuator clips 16 from the slots 18, repositioning the attenuator 14 to the "in" position, and engaging the attenuator clips 16 with slots 20.

While the present invention has been illustrated by the above description of embodiments, and while the embodiments have been described in some detail, it is not the intention of the Applicants to restrict or in any way limit the scope of the invention to such detail. Additional advantages and modifications will readily appear to those skilled in the art. For example, the attenuator 14 could be arranged to cooperate with the top or bottom of the casing 12 such that the attenuator 14 is repositionable vertically. Or the attenuator 14 could be arranged to cooperate with a side of the casing 12, instead of the rear of the casing 12, as illustrated and described. Therefore, the invention in its broader aspects is not limited to the specific details, representative apparatus and methods, and illustrative examples shown and described. Accordingly, departures may be made from such details without departing from the spirit or scope of the Applicants' general or inventive concept.

We claim:

1. A terminal unit for use in an HVAC system, comprising:

a. a casing comprising a first opening for air entering the terminal unit, a second opening for air exiting the terminal unit and a third opening for receiving an attenuator;

b. an attenuator disposed at least partially in the third opening;

wherein the attenuator is capable of being selectively repositioned between at least a first position and a second position relative to the casing.

2. The terminal unit of claim 1, further comprising a fan disposed within the casing.

3. The terminal unit of claim 1, wherein the attenuator comprises a body having a plurality of sides and being at least partially open on at least a first side.

4. The terminal unit of claim 3, wherein a second side of the body is at least partially open, and the first side or the second side is disposed within the casing.

5. The terminal unit of claim 1, further comprising means to secure the attenuator in each of the positions.

6. The terminal unit of claim 1, further comprising:

c. at least one clip fastened to the casing;

d. at least one slot disposed in the attenuator to cooperate with the clip to secure the attenuator.

7. The terminal unit of claim 6, further comprising a plurality of clips and a plurality of slots.

8. The terminal unit of claim 6, further comprising means for fastening the clip to the terminal unit.

9. The terminal unit of claim 6, wherein the clip is removably fastened to the casing.

10. The terminal unit of claim 6 wherein the attenuator defines a flow path for air entering the terminal unit.

11. The terminal unit of claim 10 wherein the interior of the casing includes a section in which air entering the terminal unit through the first opening mixes with air entering the terminal unit through the attenuator.

12. The terminal unit of claim 10 wherein the flow path defined by the attenuator is blocked when the attenuator is in the first position.

13. The terminal unit of claim 10 wherein the air entering the terminal unit through the first opening is chilled air and the air entering the terminal unit through the attenuator flow path is ambient air.

14. The terminal unit of claim 1 wherein the attenuator comprises a body having an opening on a first side, wherein in the first position the opening is positioned within the casing and in the second position the opening is at least partially positioned outside of the casing.

15. A HVAC system terminal unit comprising:

a. a casing comprising an inlet for air entering the HVAC system terminal unit, an outlet for air exiting the HVAC system terminal unit and an opening for receiving an attenuator;

b. a fan disposed within the casing to assist air in entering and exiting the HVAC system variable air volume terminal unit;

c. an attenuator received in the opening of the casing, wherein the attenuator comprises a body defining a flow path, the body having a flow inlet on a first side and a flow outlet on a second side, wherein the flow outlet is disposed within the casing, and wherein the attenuator is capable of being selectively repositioned between a first position in which a majority of the attenuator body is disposed within the casing and a second position in which a majority of the attenuator body is external to the casing;

d. at least one clip attached to the casing;

e. a first slot disposed in the attenuator to cooperate with the at least one clip to secure the attenuator in the first position; and f. a second slot disposed in the attenuator to cooperate with the at least one clip to secure the attenuator in the second position.

* * * * *